US005964584A

United States Patent [19]

Lorentz

[11] Patent Number: 5,964,584

[45] Date of Patent: Oct. 12, 1999

[54] VANE PUMP HAVING A SHAFTLESS BALANCED ROTOR

[76] Inventor: Bernt Lorentz, GroBer Ring 9, Hamburg, Germany, D-22457

[21] Appl. No.: 08/852,728

[22] Filed: May 7, 1997

Related U.S. Application Data

[62] Continuation of application No. 08/672,501, Jun. 28, 1996, abandoned, which is a continuation of application No. 08/392,788, filed as application No. PCT/EP93/02311, Aug. 26, 1993, abandoned.

[30] Foreign Application Priority Data

Sep. 2, 1992 [DE] Germany ..... 92 11 768 U

[51] Int. Cl.[6] ..... F04C 2/344; F04C 15/00

[52] U.S. Cl. ..... 418/73; 418/184; 418/188

[58] Field of Search ..... 418/71–73, 183, 418/184, 188

[56] References Cited

U.S. PATENT DOCUMENTS

| | | | |
|---|---|---|---|
| 1,079,384 | 11/1913 | Wilson | 418/73 |
| 3,153,384 | 10/1964 | Castle, Jr. et al. | 418/73 |
| 3,361,076 | 1/1968 | Davis | 418/184 |
| 3,465,682 | 9/1969 | Hartmann | 418/73 |
| 4,361,419 | 11/1982 | Vohringer | 418/73 |
| 4,764,095 | 8/1988 | Fickelscher | 418/184 |

FOREIGN PATENT DOCUMENTS

| | | |
|---|---|---|
| 1395435 | 3/1965 | France . |
| 2022841 | 11/1971 | Germany . |

*Primary Examiner*—John J. Vrablik
*Attorney, Agent, or Firm*—Friedrich Kueffner

[57] ABSTRACT

In order to provide, in vane pumps, an effective compensation of the radial and axial forces while at the same time increasing their useful service life, the vane pump for liquids is comprised of a slotted rotor (1) supported in a stator (4), wherein radially displaceable vanes (9) are slidingly disposed, which can be pressed slidingly supported while acted upon by centrifugal force, spring tension or otherwise by compressive force against a stator inside wall, in said process delivery cells are formed which expand or narrow in a crescent-like fashion and the entry of the liquid takes place through a hollow concentric stator and the filling of the vane cells from the inside to the outside. The rotor (1) is shaftless and of tubular construction, both sides are extended beyond the operating area determined by the vanes and the rotor is supported with the extensions in the outer stator, while the rotor possesses continuous vane slots from the internal to the external diameter. In the area of the rotor extensions, the frame of the stator possesses on its surface hydraulic effective surfaces acted upon by the operating pressure and/or pressure-relieved directed against the rotor for the at least partial compensation or avoidance of radially occurring forces (FIG. 1).

1 Claim, 10 Drawing Sheets

VANE PUMP HAVING A SHAFTLESS BALANCED ROTOR

This is a continuation of application Ser. No. 08/672,501 filed Jun. 28, 1996 abandoned, which is a continuation of application Ser. No: 08/392,788 filed Feb. 28, 1995, abandoned, which is a national stage of PCT/EP93/02311 filed Aug. 26, 1993.

SCOPE OF APPLICATION

The present invention relates to a vane pump for liquids, comprising a slotted rotor mounted in a stator, in which radially displaceable vanes are slidingly supported which can be pressed,while slidingly supported and while acted upon by centrifugal forces, spring forces or otherwise by compressive forces, against a stator inside wall, in the course of this delivery cells are formed which expand or narrow in a crescent-shaped fashion and the entry of the liquid takes place through a hollow concentric stator and the filling of the vane cells is effected from the inside to the outside.

STATE OF THE ART

Vane pumps are constructed in the form of fixed displacement pumps or fixed displacement motors or in the form of variable displacement pumps or adjusting motors. However, vane pumps are likewise employed in the form of volumetric meters. The advantages of the vane pumps reside in their uniform delivery flow and in their quiet running. Problems do arise though due to the respective hydraulic radial and axial bearing loads.

The hydraulic radial bearing loads in vane pumps possessing rotor lengths equal to the operating area of the vanes result from the product from the projection surface formed of rotor and projecting vane and the hydraulic pressure, i.e. the pressure differential acting upon the rotor. Lesser radial loads result from the friction of the vanes on the stator and in the rotor slots as well as from the dead weight of the rotor. In order to intercept the totally resulting radial forces and the powerful forces occurring already at small pressure differentials, the rotor shafts and supports are either dimensioned so as to be robust or it is attempted to provide an equalization by means of costly and—from a point of view of fluidics—disadvantageous multi-stroke pump or motor constructions.

The hydraulic axial bearing loads can be avoided by the symmetric design of the axial hydraulic effective areas of the rotor, in which case the hydraulic pressures exerted upon the effective areas have to be uniform. In the model preferred for reasons related to production engineering and costs and having an axially displaceable rotor, the same bears against the rotor within the area on one side, while the hydraulic pressure becomes more effective on the opposite side so that no axial power balance exists. It would be possible to provide a remedy with the aid of an axially immovable construction of the rotor support with a precise, uniform adjustment of the front end rotor gap which, however, is expensive. Thus, by way of example, for a pneumatic compressor or motor related to the subject matter of the application, pneumatic pads in some of the recesses machined into the front ends of the rotor are provided according to the DE-A 21 33 455, which are located between the guide vanes and are supplied with compressed air through ducts machined in a crescent-configured manner into the lateral covers of the housing so that, when the rotor is axially displaced, pressure differentials occur between the pnematic pads located on both sides of the rotor, which exert repellent forces in the direction of a central position.

A comparatively costly solution is likewise proposed in the DE 31 20 350 for a vane pump, in which the shaft rotor is designed possessing two large axially displaceable bushings which are acted upon by the feed pressure in pressurized gaps in axially displaceable bearing bushings on the rear sides and front ends in order to bring about a pressure equalization on the shaft rotor so as to minimize the bearing loads and frictional losses. Disadvantageous is the large and expensive number of precision components in the hydraulic operating sphere, relatively large requisite gap lengths between the high-pressure and the low-pressure area and the poor efficiency of the vane pump resulting herefrom.

Furthermore, the shaft for the motive power and the power take-off projecting from a rotary piston pump, due to the pressure differential on the shaft seal and with slip ring seals additionally gives rise to axial bearing loads by means of the spring tension of the same, unless a compensation is brought about on the opposite side by means of a symmetric construction.

Moreover, rotary piston pumps are known e.g. from the DE-AS 12 36 641. There, in a stator hollow space of uniform diameter, a cylindrical revolving rotor with a plurality of substantially radial slots, in which vanes are sliding, is supported, in which case, by means of a pertinently wavy configuration of the cross-sectional contour of the stator cavity, several delivery cells are formed between the stator and the rotor, to and from which the pumped or operating medium is supplied and removed via tangentially terminating ducts, of said intake or low-pressure side ducts located on the one side of a vane and leading to a concentric hollow rotor space, while the ducts on the high-pressure side located in each case on the other side of each vane, communicate in each case in a continuous longitudinal duct of the rotor allocated to each vane. The longitudinal ducts communicate in turn with an annular groove which communicates with the high-pressure side of the pump or the motor.

For the direct feeding and removal of the pumped medium it is also known to provide ducts leading into or out from the delivery cells, which will then have to come to communicate in turn with ducts in a stationary housing portion. The use of such rotor ducts is regarded as advantageous as far as e.g. one or more operating space(s) exist between the rotor circumferential area and the circumferential wall of the stator hollow space since, when correspondingly many intake and discharge apertures are disposed in the stator walls, large parts of the operating spaces are unable to act as areas within which the displacement cells are sealed off from the inlet side and pressure side, unless a great many pumping operations are planned which once again decrease the utilizable operating space and give rise to substantial frictional losses.

In order to be able to construct the feeding and the discharging ducts in the rotor possessing an adequate width but, on the other hand, to, avoid too great a weakening of the rotor owing to the ducts and, finally, to prevent an axisl thrust from pressure ducts having an adverse effect on the pressure, it is further proposed in the DE-AS 12 36 941 that, in the form of delivery-side ducts on the respective side of each vane, several grooves are machined into the relevant wall of the associated rotor slot, in which case, furthermore, on both sides of the rotor, one annular groove each is disposed in the side walls of the stator which face the rotor front walls, into which the delivery-side longitudinal ducts of the rotor terminate, while the annular grooves are in communication with pressure connections of the pump or the motor. The rotor hollow space, into which the low-pressure side bores of the rotor lead, is a part of a concentric longitudinal bore of a shaft connected to the rotor. However, this rotary piston pump is expensive to construct on account of the numerous radial bores—also outside the vane slots—as well as owing to the large number of outlets.

In the rotary piston pumps known according to the state of the art that are provided with vane cells for liquids, which are employed in the form of delivery pumps, an operation for liquids with elevated vapour pressure and without a positive supply feed owing to the net positive suction head rapidly rising with the rotational speed, an operation with economic drive speeds of e.g. 1450 $min^{-1}$ and higher is no longer possible.

The volumetric degree of effectiveness and the dry intake capacity (with an empty pump) of vane pumps is determined by the gap lossess, whose magnitude—with the presupposition of the same delivery product, the same manufacturing precision and pressure differential—depends on the lengths of the gaps. That is why, with a comparable pump flow, slowly rotating pumps with a correspondingly great cyclic pump volume and gap lengths, possess poorer volumetric degrees of effectiveness and a smaller dry intake capacity than rapidly rotating pumps with a correspondingly smaller cyclic pump volume and gap lengths. These technical connections mentioned, on account of the necessary reduction of the rotary speed by the net positive suction head limit also the possibilities for the constructional improvement of the volumetric effectiveness and of the dry intake capacity.

Furthermore, rotary piston pumps for liquids, as a result of the large projection area formed by rotor and projecting vanes and acted upon by the pressure differential, call for robustly dimensioned shafts and supports, unless the rotary piston pumps are constructed in the form of double-stroke vane pumps or motors which each possess two intake and discharge apertures for the liquids, a step which is costly from a product-engineering aspect and which, in the case of pumps, leads to an increase, and with it, to a deterioration of the net positive suction head.

TECHNICAL PROBLEM, TECHNICAL SOLUTION, ADVANTAGES

That is why it is the technical problem of the present invention to further develop the known vane pump in such a way that a complete or at least extensive balance of the radial and axial forces is provided, in which, with a view to a longer useful service life, the wear should be minimized and a greater degree of effectiveness achieved. So far as vane pumps are considered as volumetric meters, the measuring accuracy is intended to be improved in a like manner. It is further the object of the present invention to expand the possibilities of operational application in the form of a pump by means of a reduction of the net positive suction head and to improve the degree of effectiveness in the machine employed in the form of a pump. In addition, it is the object of the present invention to also improve the hydraulic axial and radial stresses at least in part or altogether by means of constructional steps not involving any great constructional effort.

According to the invention, the rotor of the vane pump is constructed so as to be devoid of a shaft and of tubular configuration and in that both sides are extended beyond the operating area determined by the vanes and supported with the extensions in the external stator and in that it possesses continuous vane slots from the internal to the external diameter and in that the stator frame, within the area of the rotor extensions, possesses on the surface hydraulic effective areas acted upon and/or relieved by the operating pressure directed against the rotor for the at least partial compensation or avoidance of radially occurring forces. However, in a shaftless rotor extending beyond the operating area towards both sides, the operating pressure becomes effective in the bearing gaps rotor/external stator located there, which results in further bearing loads. In comparison with it, by means of recesses (effective areas) in the stator frame relieved of the operating pressure, this radial load portion is significantly reduced.

In accordance with another embodiment of the invention the vane pump is provided with a hollow concentric stator, in which the ducts for filling the expanding vane cells are formed by means of radial recesses in the vanes and/or in the vane slots and the concentric stator possesses, on its surface, effective areas acted upon by operating pressure and directed against the rotor for the at least partial compensation of radial forces, it being possible to substitute the recesses with small bores acted upon by operating pressure which produce, in the bearing or supporting gaps rotor/external stator, larger effective areas directed against the rotor. This is simpler in the fabrication, results in comparatively lower gap losses and thereby improves the volumetric degree of effectiveness. Advantageously, this vane pump is of simple construction, a comparatively expensive additional mounting of the shaft and the frictional forces arising hereby are avoided from the outset just as axial and radial hydraulic forces are minimized.

According to another feature, the radial ducts for filling the delivery cells are formed by radial recesses in the vanes and/or in the vane slots, which proceed continuously from the external diameter to the rotor longitudinal bore in the form of internal diameter of a shaftless rotor projecting on both sides beyond the operating area determined by the vanes, while the liquid enters axially through the hollow rotor axis and the filling of the expanding delivery cells takes place in the radial direction through a window in the rotor axis and, in the further course, through recesses in the rotor slots and/or the vanes.

The rotor portion which projects beyond the operating area or the rotor portions on both sides are rotatable against the rotor, but are fitted in sealingly. In pumps, in respect to the net positive suction head, a significant advantage results since solely the introduction lossess of the liquid into the rotor slots are to be associated with the net positive suction head and the further pressure losses up to the filling of the vane cells and the speed increase of the liquids connected with this in conjunction with the centrifugal force have to be produced energy-wise by the drive. The radial filling of the vane cells from inside via the rotor slots, over and above that, has the advantage that the inclusion of the stroke volume of the vanes in the rotor slots takes place in the cyclic operating volume of the pump or of the motor without a special filling operation for this stroke volume against the centrifugal force, as is necessary in the filling of the vane cells being effected tangentially or axially from the outside according to the state of the art. The rotor axis serving at the same time as liquid intake and as a mounting means for the rotor does advantageously make possible in pumps and motors a cost-saving realization of the hydraulic, in particular radial, pressure balance by means of a hydraulic support against the rotor axis.

The recesses are thus preferably acted upon by the operating pressure given by the liquid so that no further pressure sources or control means are necessary.

According to a first embodiment, the recesses in the stator shell are located opposite the external rotor casing outside the vane operating area, thus, with regard to a vertical area passing through the vane operating area, symmetrically disposed. According to an alternative embodiment, the recesses are located in the shell of a stator pivot, which reaches through the concentric opening of a rotor tube and bears against the same in a sealing fashion. The last-mentioned embodiment possesses the advantage that the recesses may also lie at the same level as the vane operating area, whereby a reduction in the overall height may possibly result. Combinations of said embodiment are likewise possible.

According to a further construction of the invention, the rotor portion projecting beyond the vane operating area possesses an identical or reduced external diameter in comparison with a diameter in the vane operating area. A reduced diameter outside the vane operating area possesses the advantage that, in the course of the vane pump operation, the rotor receives an axial centering.

When the vane pump is inoperative, the vanes immerse into the rotor slots whereby, in a rotor possessing a continuous uniform diameter, axial displacements may be possible. In the rotor extended with reduced diameters which otherwise is axially freely movable, the diameter increases serve to center the rotor in relation to the working area, in which case it is possible to accept the aforedescribed disadvantage of the unilateral greater effectiveness of the hydraulic pressure by bearing against the oppositely located side since the effective area is kept small by a minor difference in diameter. By means of this rotor centering in relation to the operating space, between the front end areas of the rotor and the stators on both sides, the gap for a hydrostatic force balance at the same pressure is ensured.

In the rotor extended with the same diameter towards both sides, the requisite centering of the rotor relative to the operating area is effected by the vanes. The space in the guide slots underneath the vanes communicates with the vane cell located behind the vanes in the direction of rotation, e.g. by means of radial recesses in the vane and/or in the rotor. Since, in the inoperative state of the vane pump, the vanes moved outwardly by centrifugal force when operative, can be immersed into the rotor and the freely movable rotor may be axially and unilaterally displaced against the front-end stator and because this may, when the pump is started up, hinder the vanes from emerging or may even lead to a tilting or wedging within the area of the vanes not acted upon by the pressure differential, the stator parts which laterally delimit the operating space, are slightly chamfered in the direction towards the axis of rotation so as to extend the operating space. These chamferings are carried a little farther on both sides than conforms to the axial mobility of the rotor in the stator so that, when the vane pump commences to rotate, the vanes emerging due to the centrifugal force bring about an immediate centering of the rotor relative to the operating space and this is retained because of lacking axial forces also without any additional friction on the vanes.

In a special construction according to the invention of the vane pump, the rotor is constructed so as to be tubular and possesses a longitudinal bore in which an even number of vane slots terminate openly and in which, the in each case diametrically opposed vanes are rigidly interconnected or of one-piece construction.

However, alternatively to this, the rotor can, when of tubular design, also receive, in the tube apertures, a stator pivot which is hollow on the inside and, within the area of the slots passing through the rotor for the displaceable vanes, possesses a window and in which the vanes and/or the rotor slots possess radial recesses. This construction makes a partial balance of the radial hydraulic forces on the rotor possible.

By preference the rotor, at its front ends, is coupled to an axially fixated shaft as drive connection or as power take-off connection, in which case the shaft is accommodated in the stator frame.

Thus, preferably in the filling area of the delivery cells, the stator bore is effected across the area which passes through the maximal radial deflection of the vanes radially towards the outside in a pitch circle so that, by means of the recess provided hereby, a communication of two or more delivery cells exists. This step facilitates the filling of the delivery cells.

In addition, preferably the stator frame transitional area between two delivery cells is concentrically disposed with regard to the axis of rotation so that the vanes, when rotating in this area acted upon by a pressure differential, do not execute any radial movement.

According to a further construction, the outer shell of the inner stator possesses depressions which can be acted upon by the pump delivery pressure or by the input pressure of the motor for the at least partial compensation of the radial hydraulic bearing load. By means of this constructionally simply effected step it is possible to dispense with a robustly dimensioned mounting or support.

The rotor portions projecting over the vane operating area preferably possess a reduced external diameter in comparison with the rotor diameter in the vane operating area. Hereby the rotor is axially centered during the operation When the rotor is inoperative, the vanes sink into the rotor slots, which may result in an axial displacement of the rotor not possessing a reduced external diameter. In order to prevent, when the rotor is restarted, that the vanes become wedged outside their operating area with the stator inner shell, the stator shell which laterally delimits the vane operating area, within the area of the non-pressurized vanes, is conically configured so that the vanes slide constantly guided into the axially centered position when starting up.

According to a further embodiment, the rotor is connected direct or by means of a coupling on the front side located opposite the intake aperture to a shaft in the form of a drive or power take-off means, the shaft being sealingly inserted into the stator shell.

BRIEF DESCRIPTION OF THE DRAWINGS

Embodiment examples of the invention are explained below with the aid of the drawings. Thus

Figure 2A:
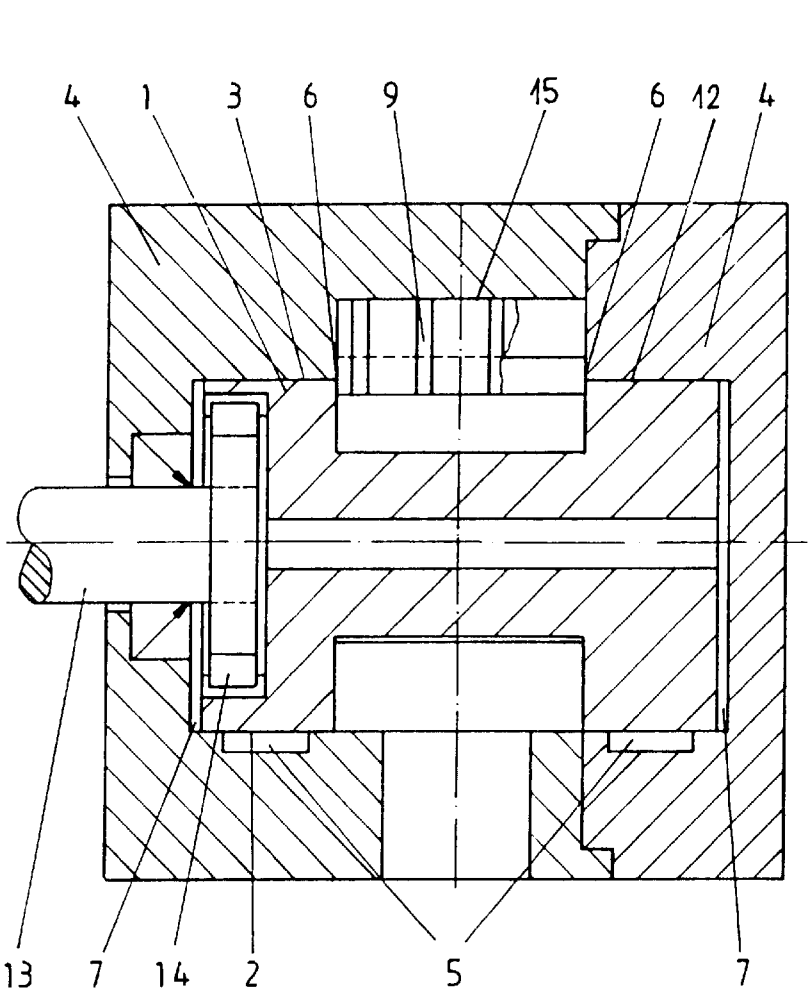
FIG. 2A shows a vertical section in the direction of line II—II in FIG. 1A.
Figure 1A:
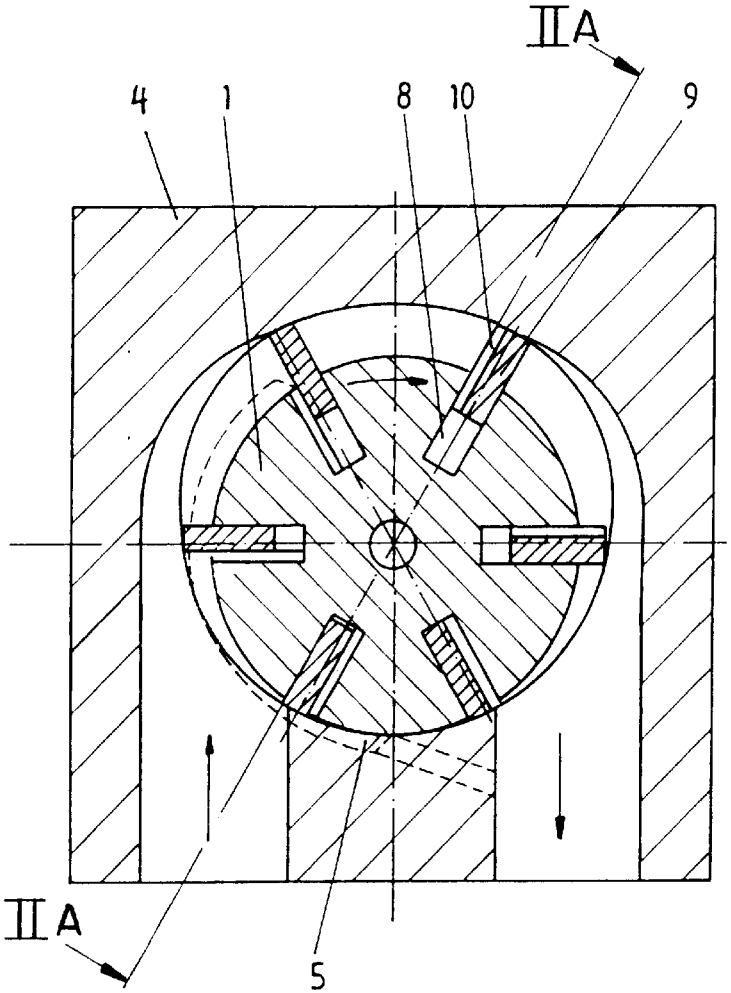
FIG. 1A shows a vertical section through a vane pump.
Figure 2B:
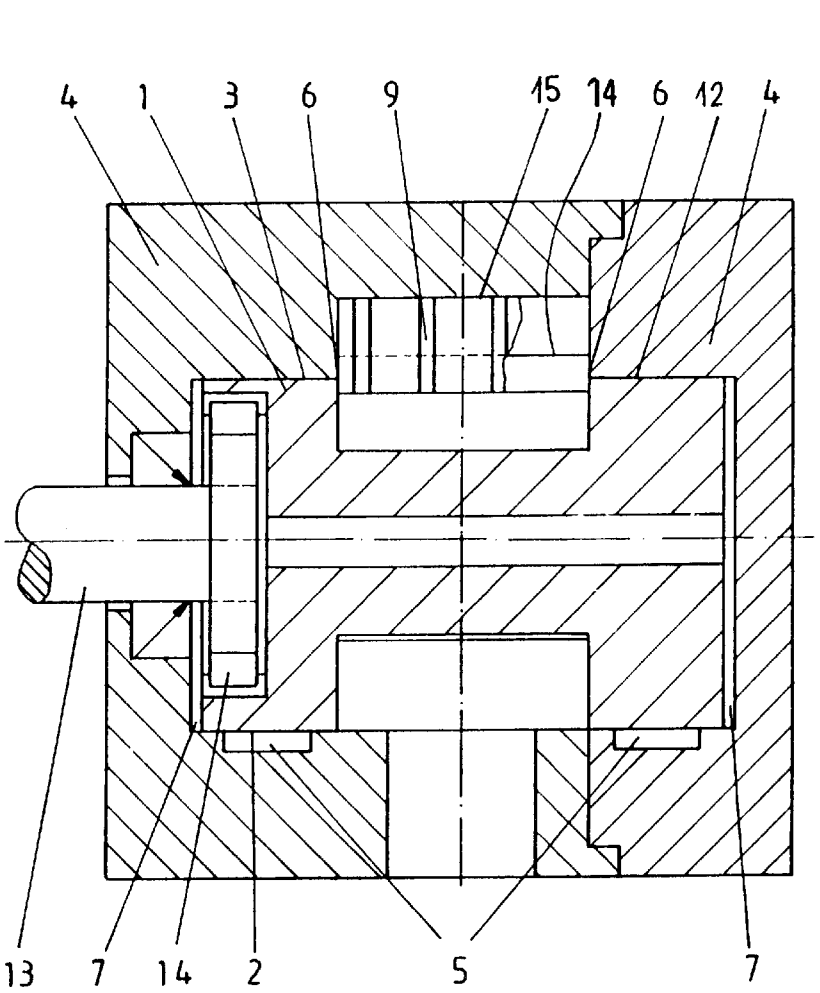
FIG. 2B shows a vertical section in the direction of line II—II in FIG. 1B
Figure 1B:
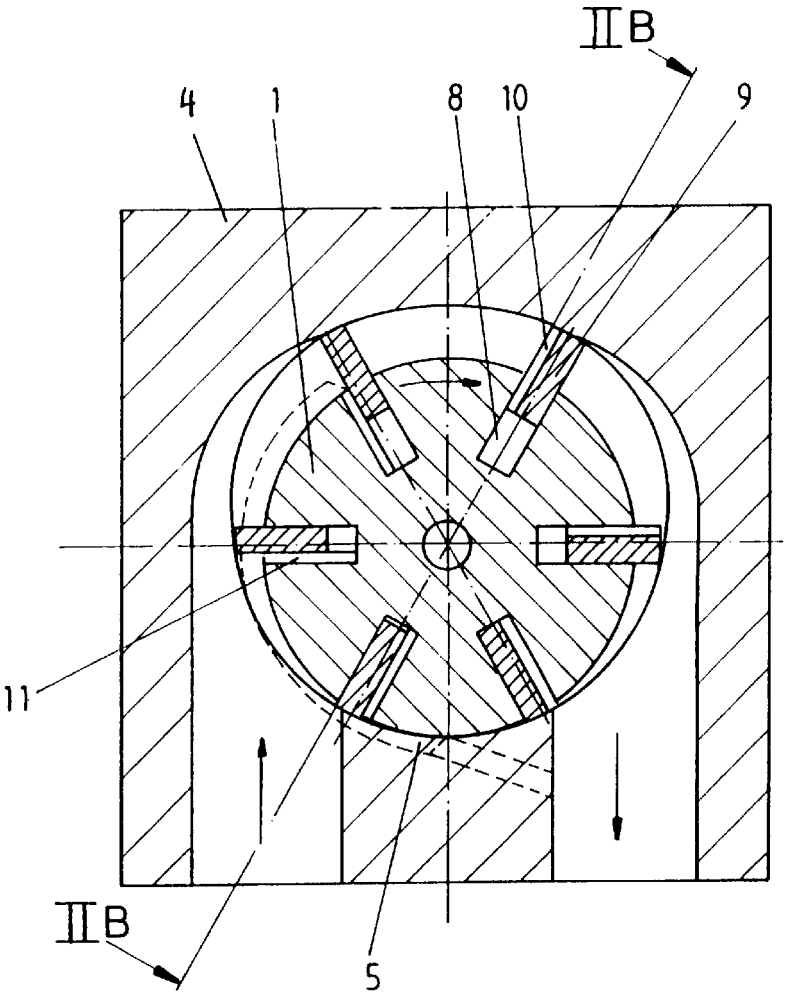
FIG. 1B shows a vertical section through another embodiment of a vane pump.

DETAILED DESCRIPTION OF THE INVENTION AND THE BEST WAY FOR REALIZING THE INVENTION

By preference the vane pump is constructed in the form of a single-stroke vane pump which, in the embodiment depicted in the FIGS. 1A, 1B, 2A, and 2B in the form of a pump, possesses a shaftless rotor 1 which, in the axial direction may either possess an external diameter 2 with a uniform circumference as in the vane operating area 15, or a circumference 3 reduced in contrast thereto. Outside the vane operating area, the rotor 1 is fitted into a stator 4 so as to be sealingly supported. Within this fitting-in area the stator possesses recesses 5 which, according to their position and size, are constructed in such a way that the operating pressure of the liquid acting herein results in a partial or complete hydraulic force balance also when taking the frictional and weight-related forces into consideration. In the embodiment illustrated in FIG. 2A, the recesses 5, when viewed in the axial direction, are disposed in front of or behind the vane operating area 15 and symmetrically thereto.

The vertical front end areas or spacing differences 6 in diameter difference existing in the top half of FIG. 2A of the rotor 1 serve at the same time for the centering of the rotor whereby, in operation, on the front end, equal gaps 7 result between the rotor front end and the, in each case, oppositely located stator front end. In the rotors extended with reduced diameters that otherwise are axially freely movable, these diameter differences 6 serve to center the rotor relative to the operating space, in which connection the previously described disadvantage of the unilaterally greater effectiveness of the hydraulic pressure by bearing against the opposite side is acceptable since the front end area 6 in the form of an effective area is kept small by means of a slight difference in diameter. By means of this centering of the rotor relative to the operating space, between the front end areas of the rotor 1 and the stator 4 on both sides, the gaps 7 for a haydrostatic force compensation at the same pressure are ensured.

Figure 3:
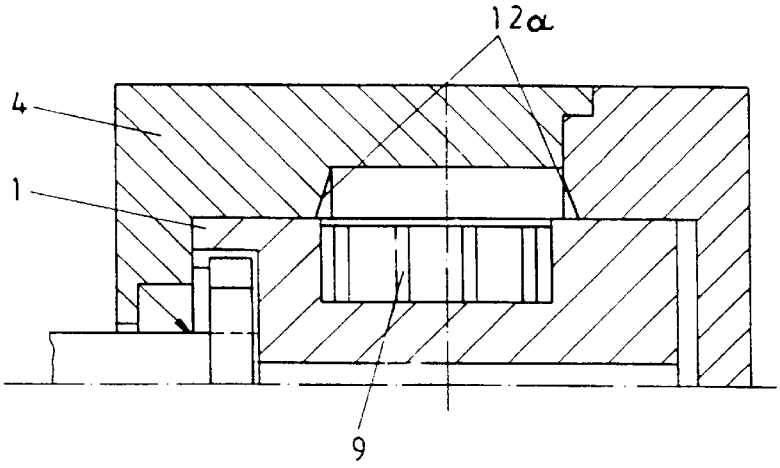
FIG. 3 shows a partial view of a longitudinal section through a vane pump with conically configured transitional areas between the vane operational area and the adjacent stator frame.

The rotor 1 possesses slots 8, each of which proceeds radially, in which the vanes 9 are slidingly guided. The space in the guide slots 8 underneath the vanes 9 communicates in each case with the vane cell located behind the vanes in the direction of rotation, in the present case by means of radial recesses 10 on the vane and/or recesses 11 in the rotor. Since, in the inoperative state of the vane pump, as depicted in FIG. 3, the vanes 9 which, in operation, are moved outwardly by centrifugal force, can be immersed in the rotor and the freely movable rotor 1, whose diameter has not been reduced, may be displaced axially on one side against the front end of the stator 4, whereby, when the vane pump is started up, the vanes 9 are prevented from emerging, which may lead to as much as a wedging of the vanes on the stator inner wall in question, within the area of the vanes 9 that are not acted upon by differential pressure, the stator inner frame components 12 laterally delimiting the operating space are constructed in the direction towards the axis of rotation so as to be conical or slightly chamfered, thus expanding the working space. These conical or chamfered stator inner frame components 12A do extend on both sides insignificantly further than conforms with the axial mobility of the rotor 1 in the stator so that, with the start of rotation of the vane pump, the vanes emerging due to centrifugal force immediately bring about a centering of the rotor 1 relative to the operating space 15 and the same is retained in the case of lacking axial forces also without any additional friction on the vanes 9.

The drive and power take-off connection of the vane pump is effected by means of a shaft 13 projecting into the stator frame 4 and sealed there, which is connected by means of a coupling 14 with the rotor in a non-interacting manner.

Figure 4:
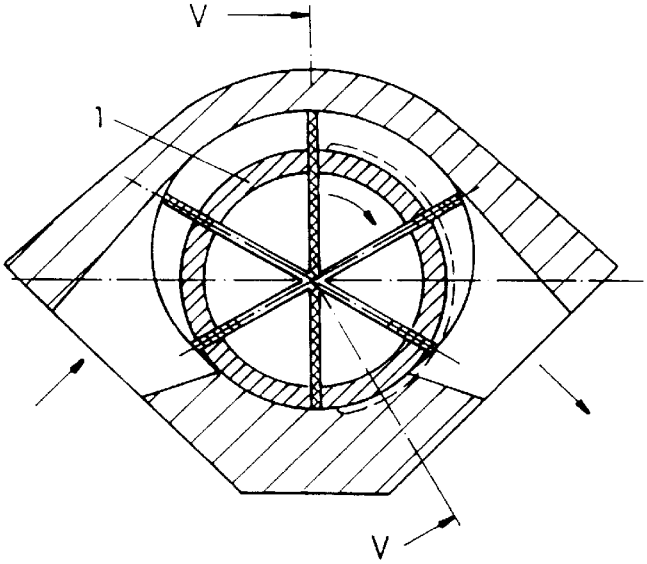
FIG. 4 shows a sectional view of a vane pump with a rotor possessing a concentric bore into which a stator pivot is fitted.
Figure 5:
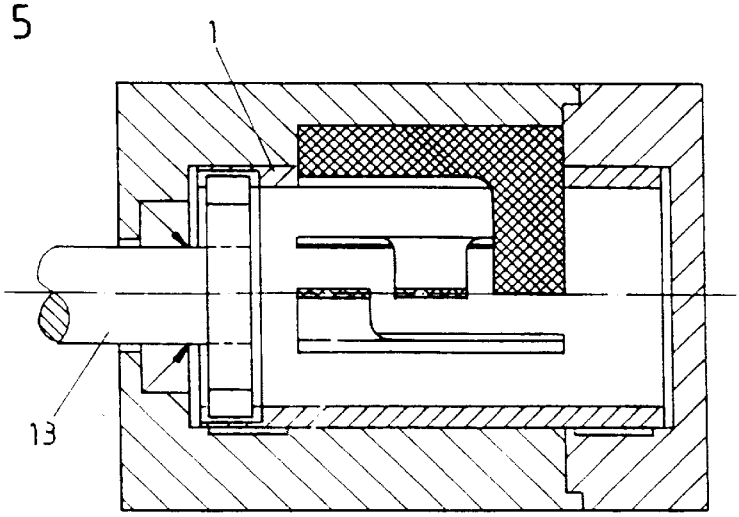
FIG. 5 shows a vertical section in the direction of line V—V in FIG. 4.

In the alternative embodiment according to the FIGS. 4 and 5, the rotor 1 is of tubular construction, in which case a stator pivot 16 projects concentrically into the tube aperture while the stator pivot 16 is rigidly connected with the other stator components. By means of this construction, the hydraulic operating pressure within the area of the tube slots does not become effective on the rotor. The remaining hydraulic forces and the radial forces given rise to by both weight and friction are partially or completely compensated by means of recesses 17 acted upon by the hydraulic operating pressure on the surface of the concentric stator pivot 16 in pumps in the area of the narrowing vane cells and in motors in the area of the expanding vane cells dependently of the size and position of the recesses.

Figure 7:
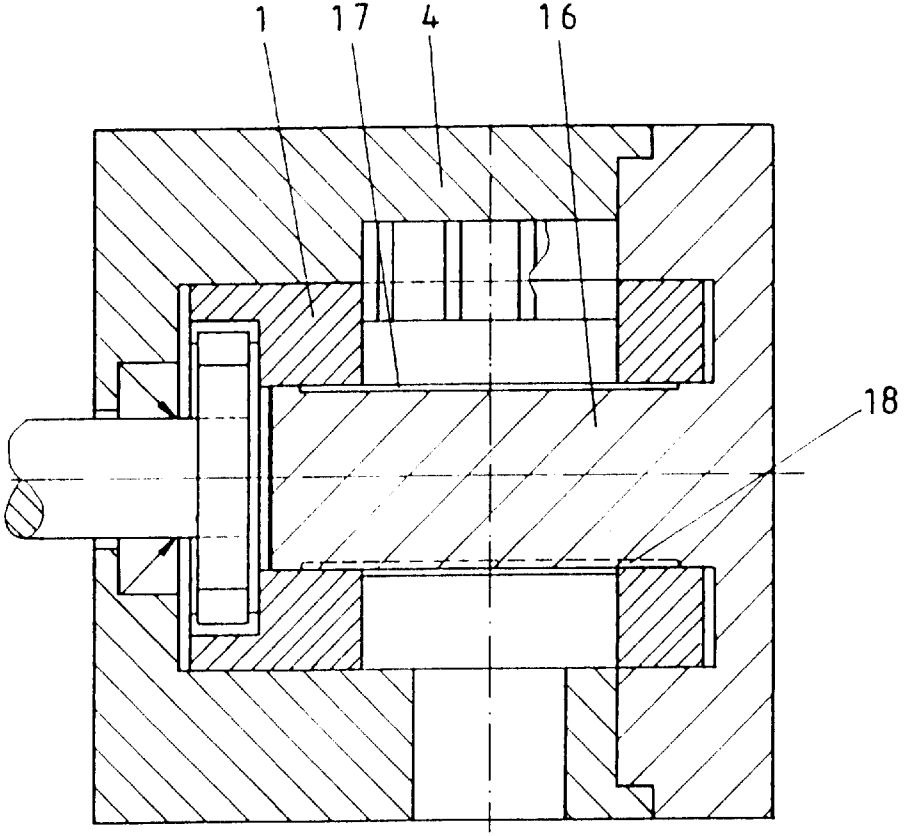
FIG. 7 shows a vertical section in the direction of line VII—VII in FIG. 6A.
Figure 6:
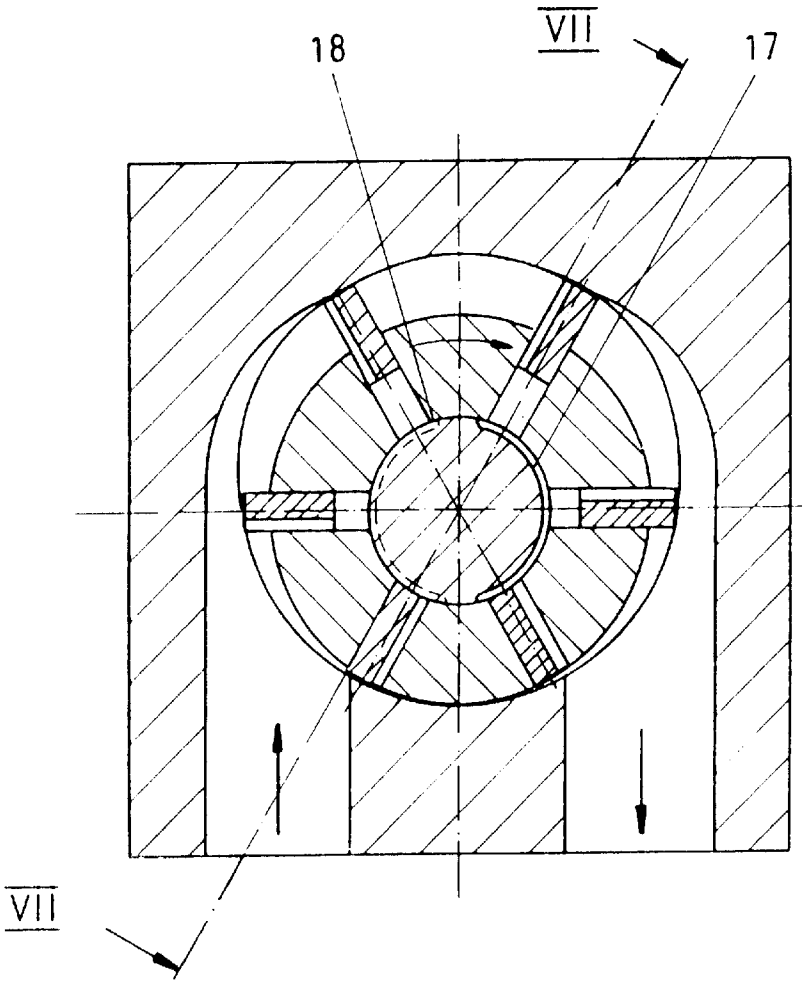
FIG. 6A shows an embodiment in which the concentric stator to the intake connection is constructed, in a vertical section.
FIG. 6B shows an alternative embodiment to that of FIG. 6A.
Figure 7A:
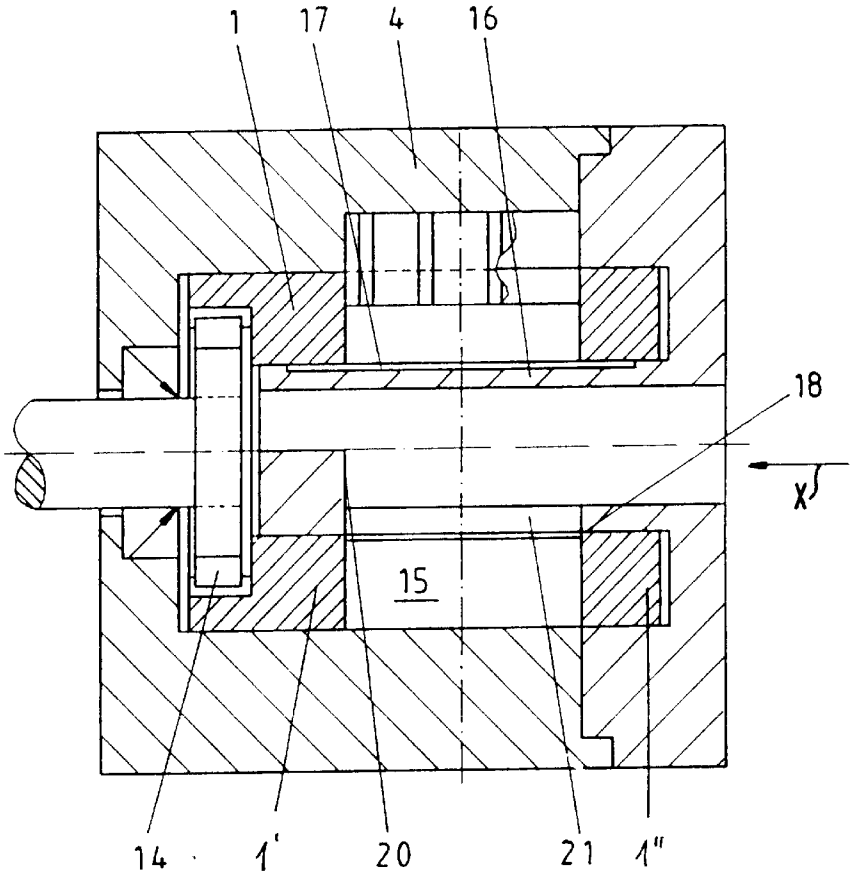
Figure 6A:
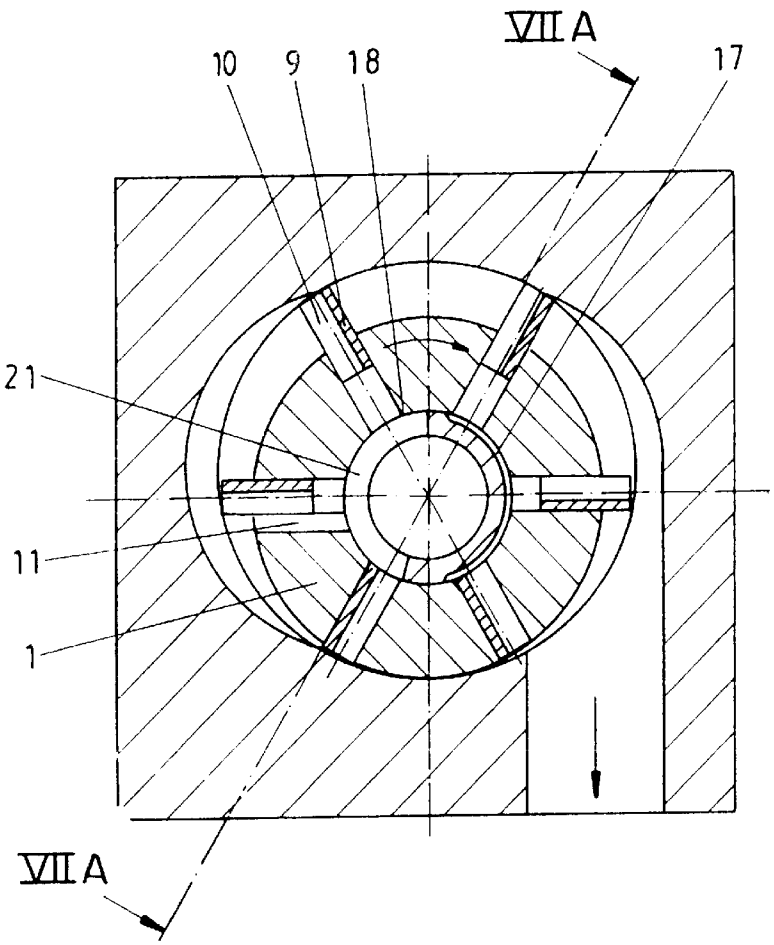
Figure 7B:
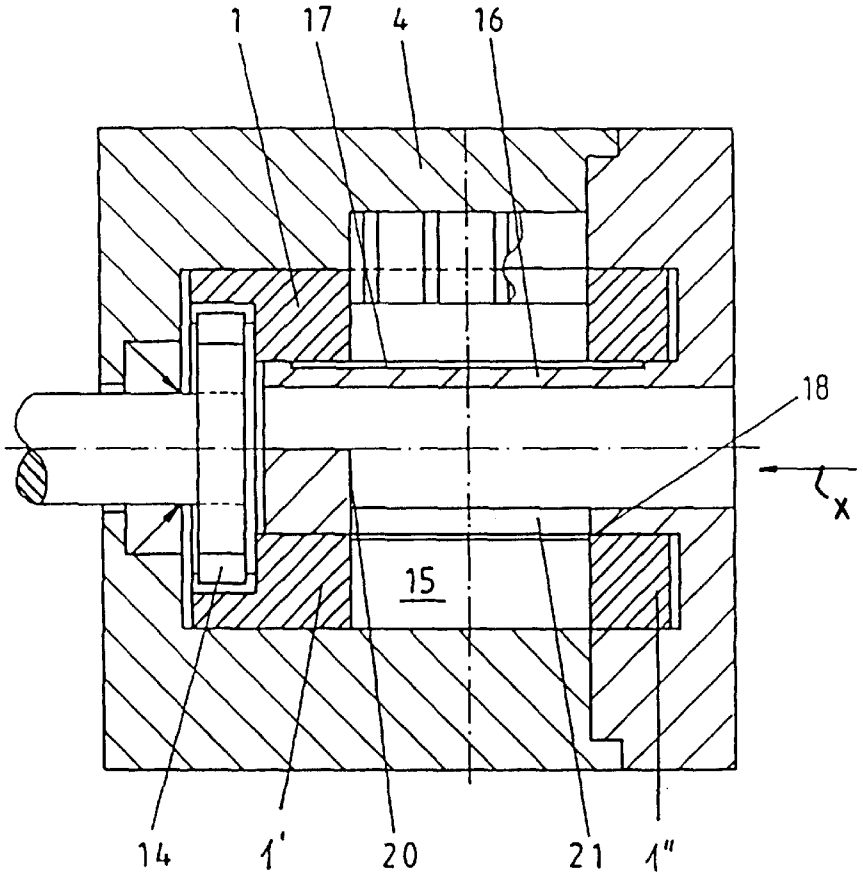
Figure 6B:
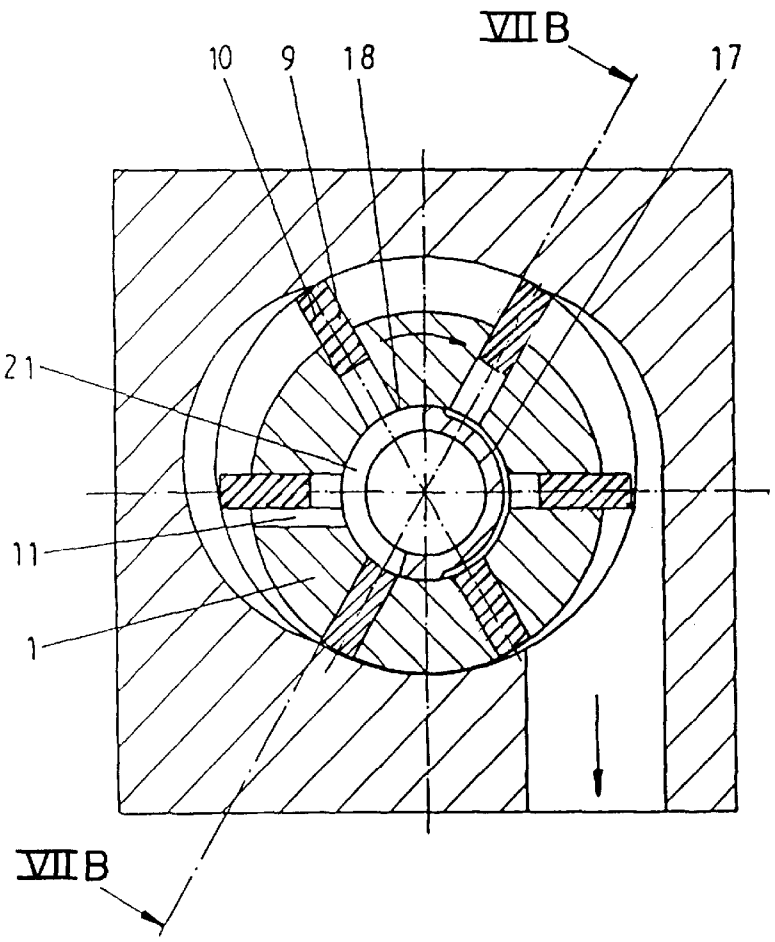

Whereas in the embodiments described in the foregoing the filling of the expanding vane cells takes place substantially tangentially from the outside, in the embodiment depicted in the FIGS. 6A, 6B, and 7, an intake connection x is provided on the stator pivot 16 which is constructed so as to be hollow up to the end of the operating space width 20. This stator is provided with a window 21 in the operating area 15 of the expanding vanes 9, in which case, in the vanes 9 and/or in the rotor 1, radial recesses 10 and 11 are provided, through which the expanding vane cells are filled with the assistance of the centrifugal force. The recesses 10 and 11, when viewed in the direction of rotation, are located on the rear of the vanes and/or in the rotor immediately behind the vanes.

Figure 8:
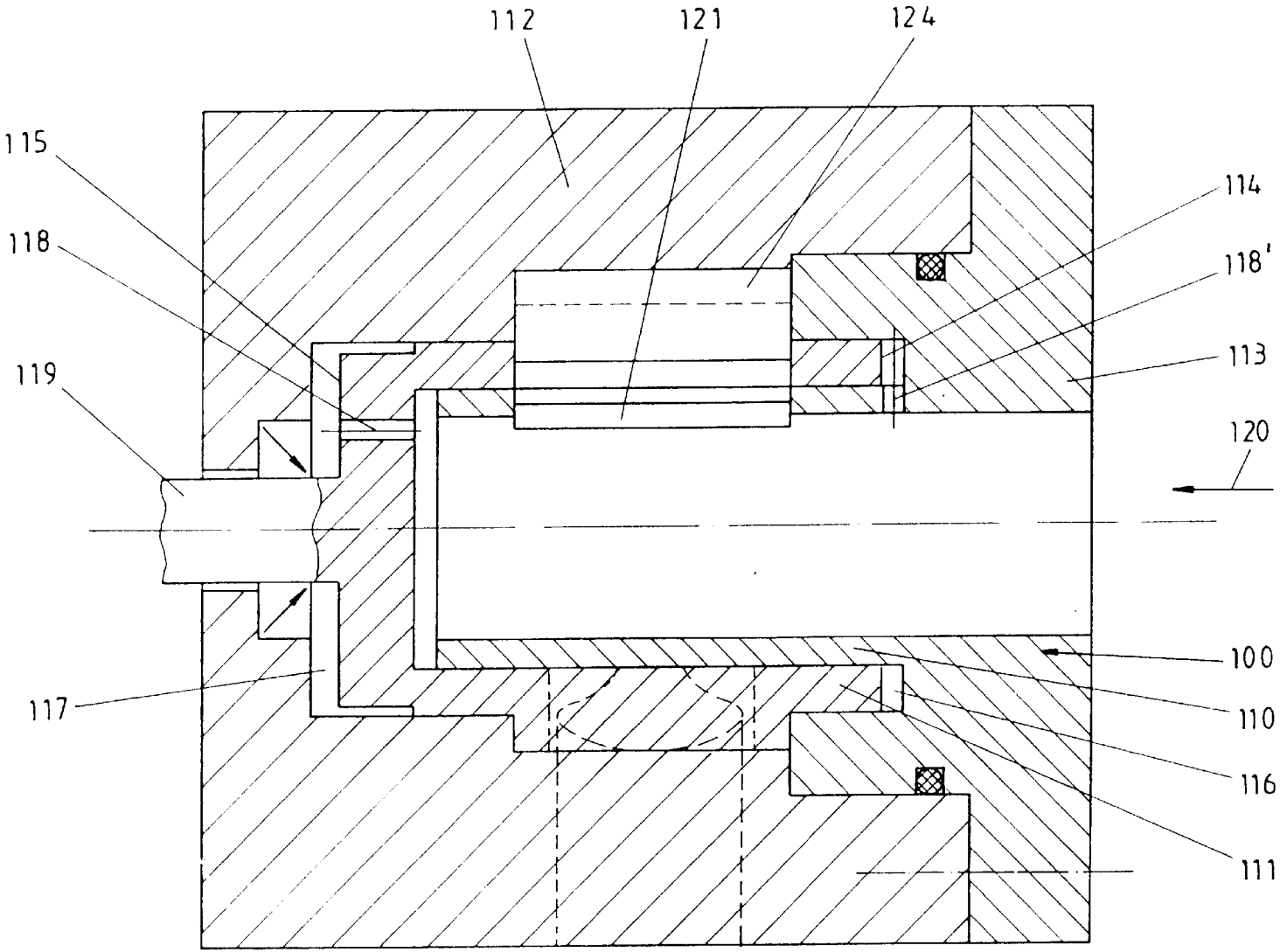
FIG. 8 shows a longitudinal cross-section of a further embodiment of a vane pump.
Figure 9A:
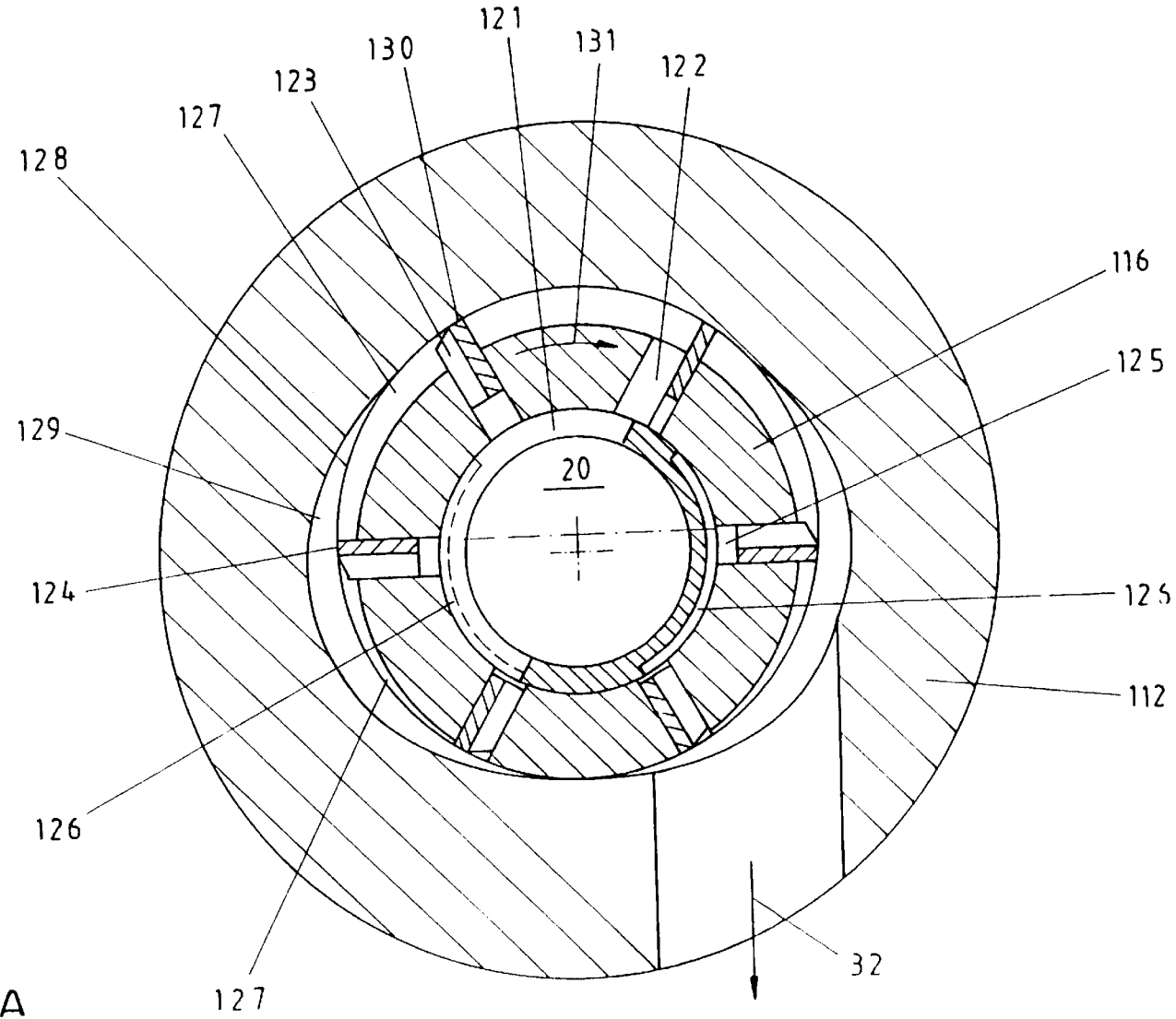
FIG. 9A shows a cross-section at the level of the vane operating area vertically to the section as per FIG. 8.
Figure 9B:
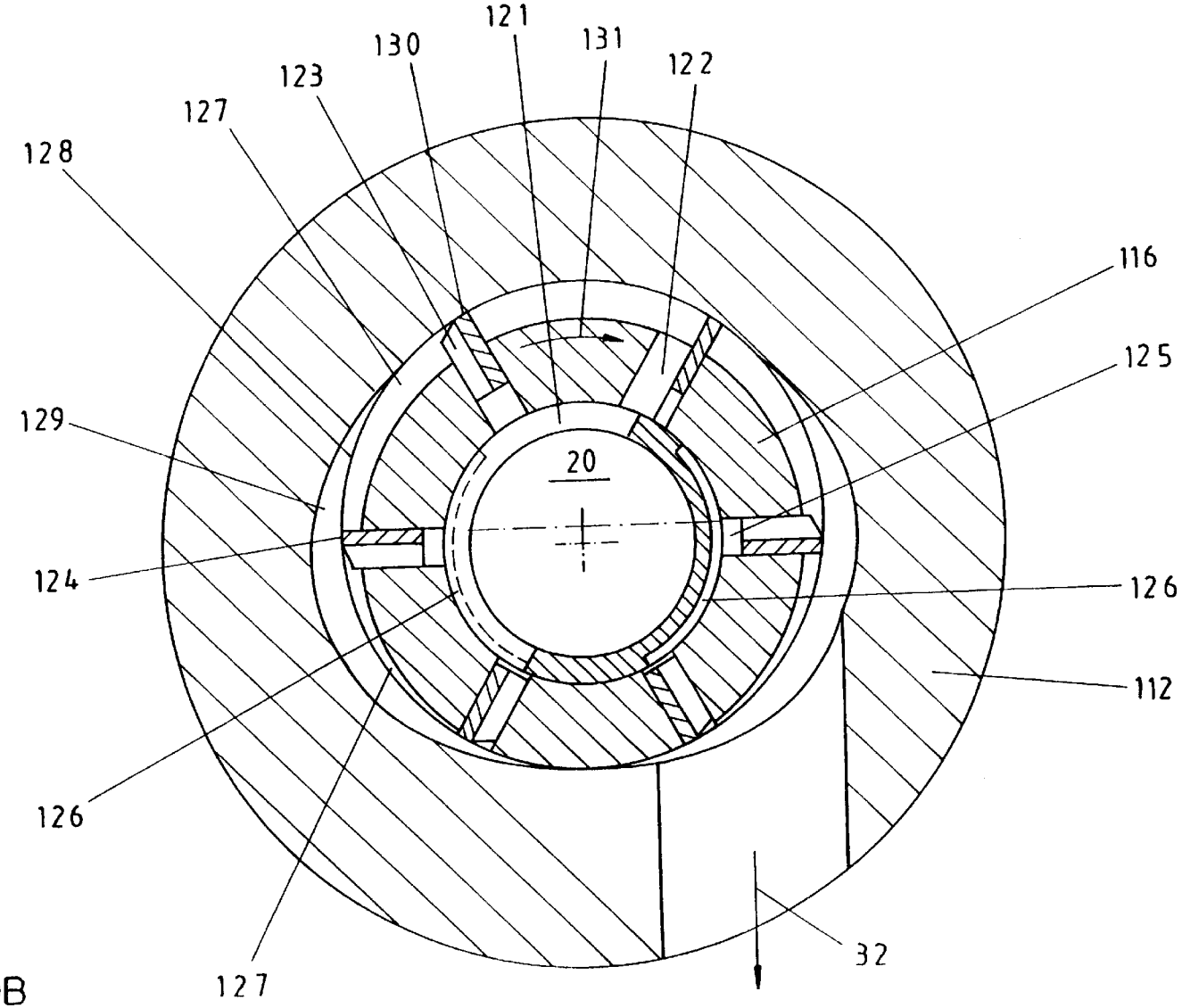
FIG. 9B shows an alternative embodiment of that of FIG. 9A.

The vane pump depicted in the FIGS. 8A and 9B is substantially comprised of a rotor 111 mounted on a hollow shaft 110 in the form of an inner frame 100, which is disposed so as to be rotatble and surrounded by the latter in its stator 112. The stator 112 may—as can be gathered from FIG. 8—be of two-piece construction, more particularly with a structural element 113 integrated with the hollow shaft 110. The rotor 111 possesses, outside the operating area determined by the vanes 124 (FIG. 8), in each case laterally from these, a reduced diameter and, with its outer shell surface, bears sealingly against the stator inner shell. In each case, between the front ends 114 and 115 of the rotor, a gap 116 or 117 is formed relative to the oppositely located front end of the stator, which is pressurized. By way of example, an axial bore 118 and a radial bore 118' take care of a pressure equalization between the gaps 116 and 117. On the drive side and on the power take-off side, the rotor is connected either direct or by means of a non-depicted coupling, with a shaft 119 which is supported so as to be sealed in the stator frame or rotatably in the drive or in the power take-off means. The hollow shaft 110 is constructed in the form of a front-end intake aperture that is accessible in the direction of the arrow 120, which communicates via a window opening 121 of the hollow shaft by means of pertinent recesses of the rotor with radially extending groove-like recesses 112 in the rotor and recesses 123 in the vanes. The vanes 124 are located in radial slots 125 of the rotor 111. The inner shell 100 is provided with depressions 126 on its running surface which are hydraulically acted upon by the pump delivery pressure or by the input pressure of the motor and, in size and position, are disposed in such a way that the radial hydraulic bearing load is partially or completely compensated.

The space located between the rotor 111 and the stator 112 with the crescent-shaped delivery cells 127 is in each case subdivided by vanes 124, which rotate on the area depicted with the arch 128 with the respective vane end. Over and above that, the stator inner shell posesses additional recesses 129 which project in a crescent-like fashion over the maximal radial deflection (curve 128).

Between an expanding and a narrowing delivery cell 127, a transfer area 130 is provided, in which the vanes 124, when rotating in the direction of the arrow 131, do not execute a radial movement.

The vane pump according to the FIGS. 8A and 9B functions as detailed below.

The liquid which streams in the direction of the arrow 120 is conducted via the window opening 121 into the groove-like radial recesses 122, 123 radially outwardly into the delivery cells 127 and substantially tangentially conducted away in the direction of the arrow 132. The entry of the liquid through the hollow axis and the filling of the expanding vane cells from the inside to the outside is effected in pumps very largely by the energy supply from the drive and, even at high rotational speeds, leads to low net positive suction heads. It is possible at the same time to provide a hydraulic compensation by means of simple constructional steps.

Figure 11:
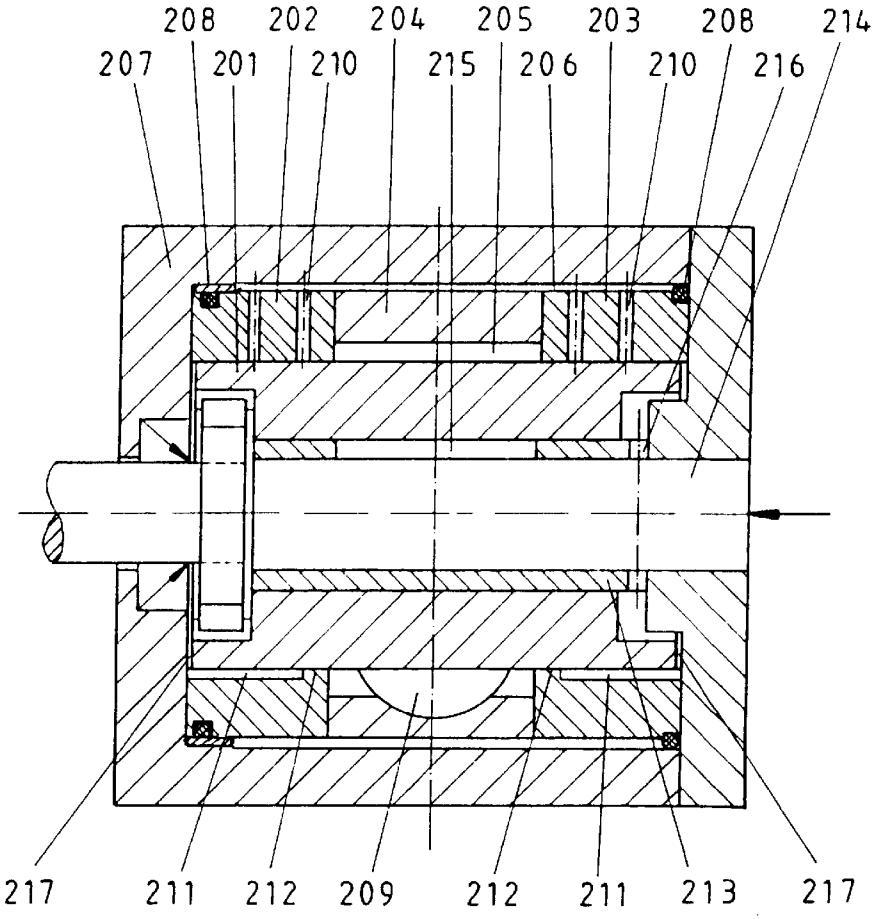
FIG. 11 shows a vertical section in the direction of line XI—XI in FIG. 10.
Figure 10:
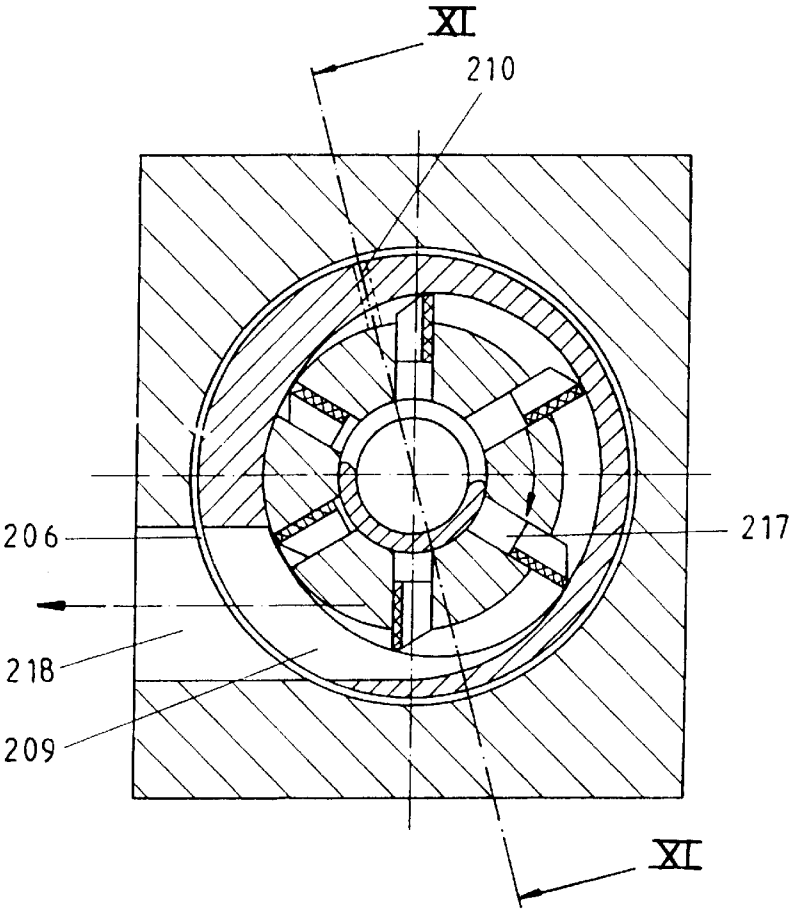
FIG. 10 shows a vertical section through the vane pump.

In the FIGS. 10 and 11, based on the example of the pump, a functionally and, from the viewpoint of production engineering, particularly advantageous form of the equalization of the radial hydraulic compressive forces acting upon the rotor is illustrated.

The tubular rotor 201 is provided with friction bearings in both supports 202 and 203. The single-stroke suction ring 204 constitutes the operating space 205 and is rigidly connected with the bearings 202 and 203. This three-piece externally cylindrical stator is inserted with a gap 206 that carries liquid or can be passed through by liquid into the pump casing 207 and sealed e.g. with the aid of sealing rings 208 at both ends relative to the pump casing. The pressure vent 209 located in the suction ring, in the course of its passage to the pertinent outlet connection piece 218 of the casing 207 acts upon the gap 206 with the respective operating pressure of the pump.

Located opposite the radial hydraulic compressive forces acting upon the rotor, approximately in the direction of the line of intersection of FIG. 10, one or several radial bores 210 are disposed in the bearings 202 and 203, which allow antagonistic compressive forces within the bearing areas to become effective upon the rotor and which lead to partial or complete pressure balance.

The stator frame 213 is fitted in a contactless fashion, but with a narrow gap into the internal diameter of the rotor 201. Via the entry bore 214 of the stator frame 213 which is continuous to the drive side and the window 215 within the area of the expanding vane cells, the filling of the same is effected. The input pressure is effective via the through bore 214 and the bore 216 on both front ends of the rotor.

In order to restrict the hydraulic radial pressures very largely to the operating area, i.e. the axial length of the suction ring, the bearings, within the circumferential effective area of the hydraulic radial compressive forces, are provided with recesses 211 which, via the gap 217 and the bores 214 and 216, communicate with the low-pressure sides so that, in the area of the recesses 211, only a small bearing length 212 remains which is adequate for sealing and support.

The hydraulic operating pressure acts through the slots 217 without constituting a load on the rotor, on the stator frame direct and, in addition, the gap between rotor and stator frame is acted upon by pressure via the rotor slots, which contributes to a further partial equalization of pressure.

I claim:

1. A vane pump for liquids comprising a stator having an inner wall surface and a hollow center, a shaftless and tubular rotor mounted on the hollow center of the stator, the rotor having in a vane area thereof radially extending vane slots, the vane slots extending from an inner diameter to an outer diameter of the rotor, a vane being slidably mounted in each vane slot, the vanes being configured to be pressable against the inner wall surface of the stator when a compressive force is applied to the vanes, radial recesses being defined in at least one of the vane slots and the vanes, crescent-shaped delivery cells with an increasing or decreasing width being formed between the outer diameter of the rotor, the inner wall surface of the stator and adjacent vanes, the rotor having at both ends thereof extensions protruding beyond the vane area, the extensions having a diameter one of equal to and smaller than the outer diameter of the rotor in the vane area, the extensions being received in the stator so as to form a gap seal, wherein the liquids enter axially through the hollow center of the stator and radially through a window defined in the hollow center of the stator in an area of a delivery cell with an increasing width and through the radial recesses into the delivery cell with the increasing width, the hollow center of the stator having recesses adjacent the extension of the rotor, wherein the recesses are configured to receive an operating pressure and the recesses having a location and size configured to partially or completely compensate radially directed hydraulic and weight-related forces.

* * * * *